US010062991B2

(12) United States Patent
Wang et al.

(10) Patent No.: US 10,062,991 B2
(45) Date of Patent: Aug. 28, 2018

(54) CARD EDGE CONNECTOR

(71) Applicant: FOXCONN INTERCONNECT TECHNOLOGY LIMITED, Grand Cayman (KY)

(72) Inventors: Xin-Wei Wang, Kunshan (CN); Guo-Xiang Niu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/681,448

(22) Filed: Aug. 21, 2017

(65) Prior Publication Data

US 2018/0054009 A1 Feb. 22, 2018

(30) Foreign Application Priority Data

Aug. 19, 2016 (CN) ..... 2016 2 0907521 U

(51) Int. Cl.

| | |
|---|---|
| ***H01R 4/48*** | (2006.01) |
| ***H01R 12/72*** | (2011.01) |
| ***H01R 12/52*** | (2011.01) |
| ***H01R 12/70*** | (2011.01) |

(52) U.S. Cl.

CPC ..... *H01R 12/721* (2013.01); *H01R 12/52* (2013.01); *H01R 12/7023* (2013.01); *H01R 2201/06* (2013.01)

(58) Field of Classification Search

CPC ..... H01R 12/7076; H01R 13/5025; H01R 13/629; H01R 13/62; H01R 13/7175; H01R 12/7005; H01R 13/64

USPC ..... 439/630, 629, 152, 327, 607.54, 607.1, 439/159, 681, 637

See application file for complete search history.

(56) References Cited

U.S. PATENT DOCUMENTS 5,035,631 A * 7/1991 Piorunneck ..... H01R 13/65802 439/108
5,478,259 A * 12/1995 Noschese ..... H01R 23/6873 439/108
5,620,342 A * 4/1997 Kinross ..... H01R 13/193 439/630
5,688,147 A * 11/1997 Coteus ..... H01R 12/7005 439/633

(Continued)

FOREIGN PATENT DOCUMENTS

TW M294139 7/2006

*Primary Examiner* — Abdullah Riyami
*Assistant Examiner* — Nader Alhawamdeh
(74) *Attorney, Agent, or Firm* — Wei Te Chung; Ming Chieh Chang

(57) ABSTRACT

A card edge connector includes an insulative housing, a plurality of conductive terminals and a pair of metal members. The insulative housing defines two side walls extending in a longitudinal direction and a central slot disposed between said two side walls, the conductive terminals are disposed in the insulative housing and protruding into the central slot, the pair of metal members enclose the insulative housing, wherein each side wall defines an embedded groove recessed from a top surface thereof and extending along the side wall in said longitudinal direction, each metal member defines a main portion enclosing an outside of the side wall and a bending portion bending from an upside thereof, the bending portion is retained in the embedded groove to provide a stability for the card edge connector.

17 Claims, 10 Drawing Sheets

(56) References Cited

U.S. PATENT DOCUMENTS 5,842,880 A * 12/1998 Pei ..... H01R 12/7005 439/327
5,957,708 A * 9/1999 Lin ..... H01R 12/7005 439/157
6,093,046 A * 7/2000 Chiou ..... H01R 12/7005 439/378
6,322,388 B1 * 11/2001 Akio ..... H01R 13/5812 439/459
6,663,402 B1 * 12/2003 Yu ..... H01R 13/65802 439/108
6,672,887 B1 * 1/2004 Yu ..... H01R 13/65802 439/108
6,695,630 B1 * 2/2004 Ku ..... H05K 7/1431 439/152
6,821,149 B2 * 11/2004 Lai ..... H01R 23/6873 439/607.31
7,108,554 B2 * 9/2006 Huang ..... H01R 23/6873 439/378
7,207,815 B1 * 4/2007 Ju ..... H01R 12/7029 439/159
7,442,093 B2 * 10/2008 Li ..... H01R 12/721 439/633
7,491,092 B2 * 2/2009 Zhu ..... H01R 13/6456 439/633
7,771,232 B2 * 8/2010 Si ..... H01R 12/716 439/607.01
8,038,459 B2 * 10/2011 Hayauchi ..... H01R 13/5213 439/301
8,092,239 B2 * 1/2012 Nishiyama ..... H01R 12/7005 439/157
8,794,988 B2 * 8/2014 Tanaka ..... H01R 12/83 439/326
9,780,512 B2 * 10/2017 Hsu ..... H01R 33/97
2005/0277334 A1 * 12/2005 Huang ..... H01R 23/6873 439/607.01
2007/0254526 A1 * 11/2007 Lai ..... H05K 1/18 439/637
2010/0323549 A1 * 12/2010 Hayauchi ..... H01R 13/5213 439/357
2012/0135618 A1 * 5/2012 Shen ..... H01R 12/721 439/152
2013/0084723 A1 * 4/2013 Shen ..... H01R 12/7029 439/159
2013/0095679 A1 * 4/2013 Li ..... H01R 12/7005 439/157
2015/0318627 A1 * 11/2015 Berry, Jr. ..... H01R 12/7076 714/6.32
2016/0020539 A1 * 1/2016 Li ..... H01R 12/707 439/155
2016/0020540 A1 * 1/2016 Shen ..... G06F 1/203 439/155

* cited by examiner

CARD EDGE CONNECTOR

BACKGROUND OF THE DISCLOSURE

1. Field of the Disclosure

The present disclosure relates to a card edge connector, and particularly to a card edge connector equipped with metal members thereof.

2. Description of Related Arts

As disclosed in Taiwan patent No. M294139, a card edge connector mounted to a circuit board for interfacing with an electronic card, the card edge connector comprises an insulative housing, a plurality of conductive terminals enclosed in the insulative housing, a locking mechanism mounted on one end of the insulative housing and a metal shell covering the insulative housing, the insulative housing defines a central slot and two end walls located at both ends of the central slot, the central slot of the card edge connector defines a fool-proof key for fear that the electronic card inserting to a wrong place. However, the cooperation of the metal member and the insulative housing is only depend on the tab of the insulative housing matched with the aperture of the metal member, during the insertion and removal of the electronic card is easy to cause the metal member falling off from the connector. In addition, the metal member covers the top face of the housing except the central slot, thus blocking heat transfer via the upper opening of each terminal-receiving passageway disadvantageously.

Hence, an improved card edge connector is required to overcome the disadvantages of the related art.

SUMMARY OF THE DISCLOSURE

Accordingly, an object of the present disclosure is to provide a card edge connector with reliable and enhanced stability function derived from the corresponding associated metal members.

To achieve the above object, a card edge connector includes an insulative housing, a plurality of conductive terminals and a pair of metal members. The insulative housing defines two side walls extending in a longitudinal direction and a central slot disposed between said two side walls, the conductive terminals are disposed in the insulative housing and protruding into the central slot, the pair of metal members enclose the insulative housing, wherein each side wall defines an embedded groove recessed from a top surface thereof and extending along the side wall in said longitudinal direction, each metal member defines a main portion enclosing an outside of the side wall and a bending portion bending from an upside thereof, the bending portion is retained in the embedded groove to provide a stability for the card edge connector.

Other objects, advantages and novel features of the disclosure will become more apparent from the following detailed description when taken in conjunction with the accompanying drawings.

DETAILED DESCRIPTION OF THE PREFERRED EMBODIMENT

Figure 1:
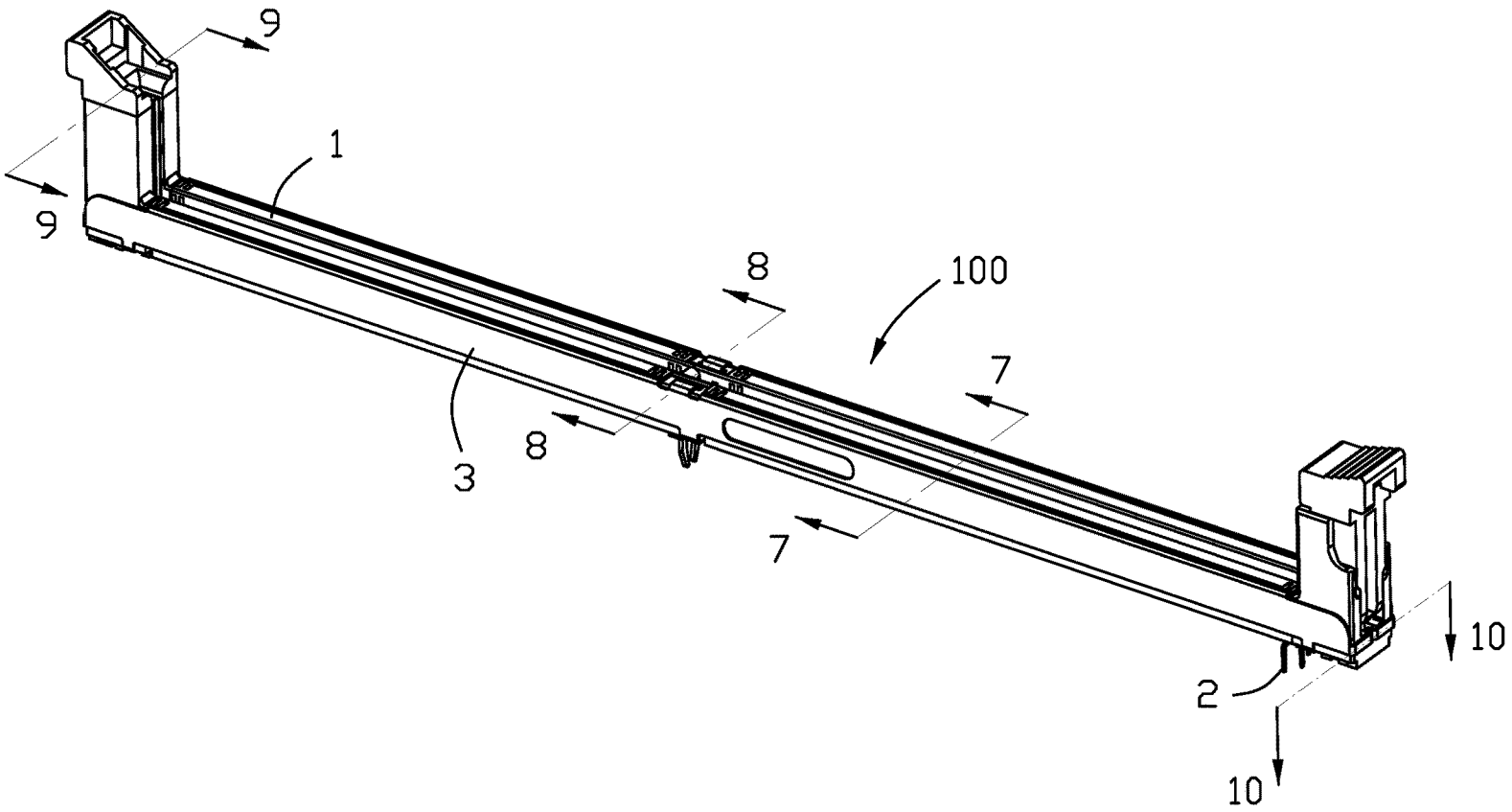
FIG. 1 is a perspective view of a card edge connector including two metal members.

Reference will now be made in detail to the embodiments of the present disclosure. The insertion direction is an up-to-down direction. Referring to FIGS. 1-7, a card edge connector 100 is assembled to a print circuit board (not shown) for an electronic card (not shown) to insert. The card edge connector 100 includes a longitudinal insulative housing 1, a plurality of conductive terminals 2 disposed in the insulative housing 1, a pair of metal members 3 enclosing the insulative housing 1 and a least one latching mechanism 4 disposed on one end of the insulative housing 1 for latching the electronic card.

Figure 2:
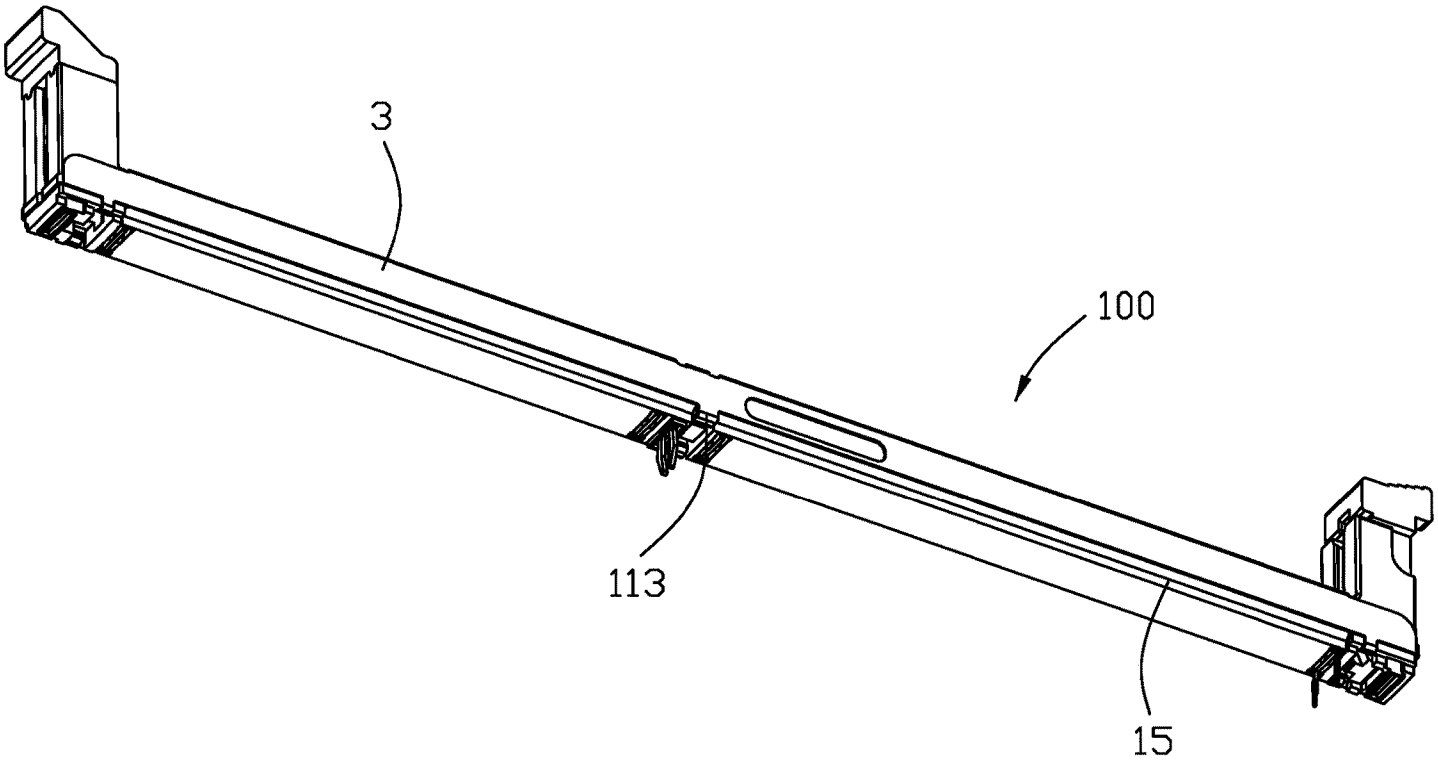
FIG. 2 is another perspective view of the card edge connector of FIG. 1.
Figure 3:
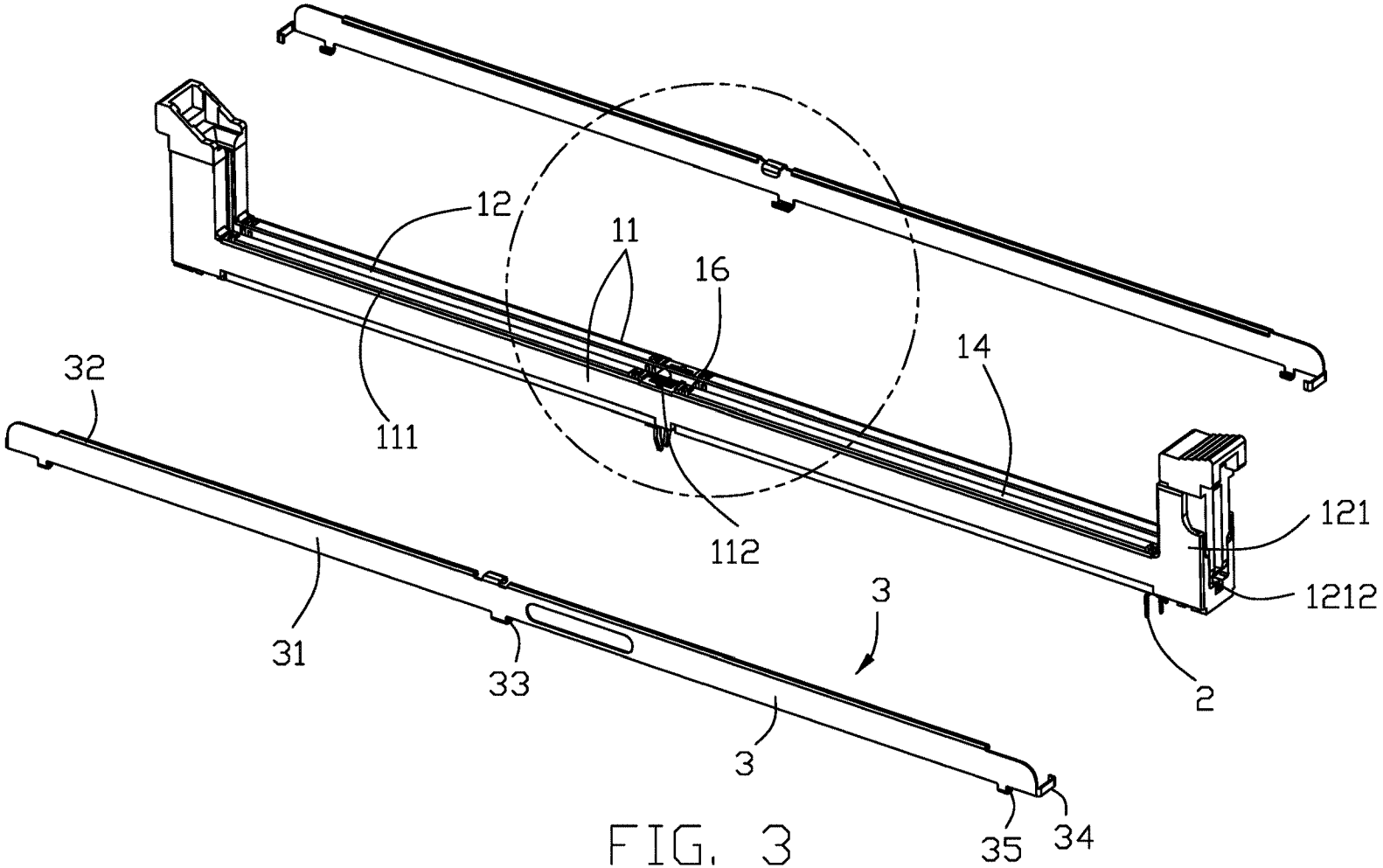
FIG. 3 is an exploded perspective of the card edge connector of FIG. 1.
Figure 4:
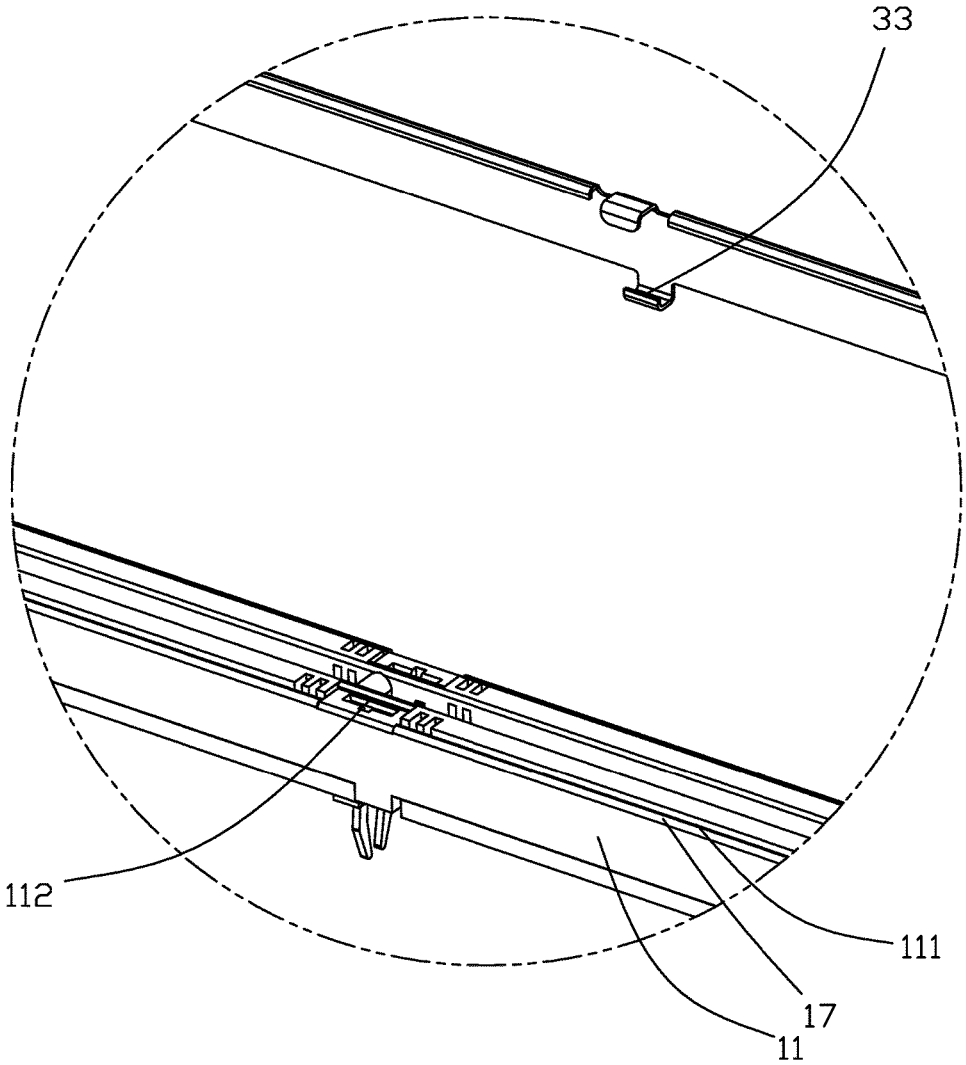
FIG. 4 is partial enlarged view of the card edge connector of FIG. 3.
Figure 5:
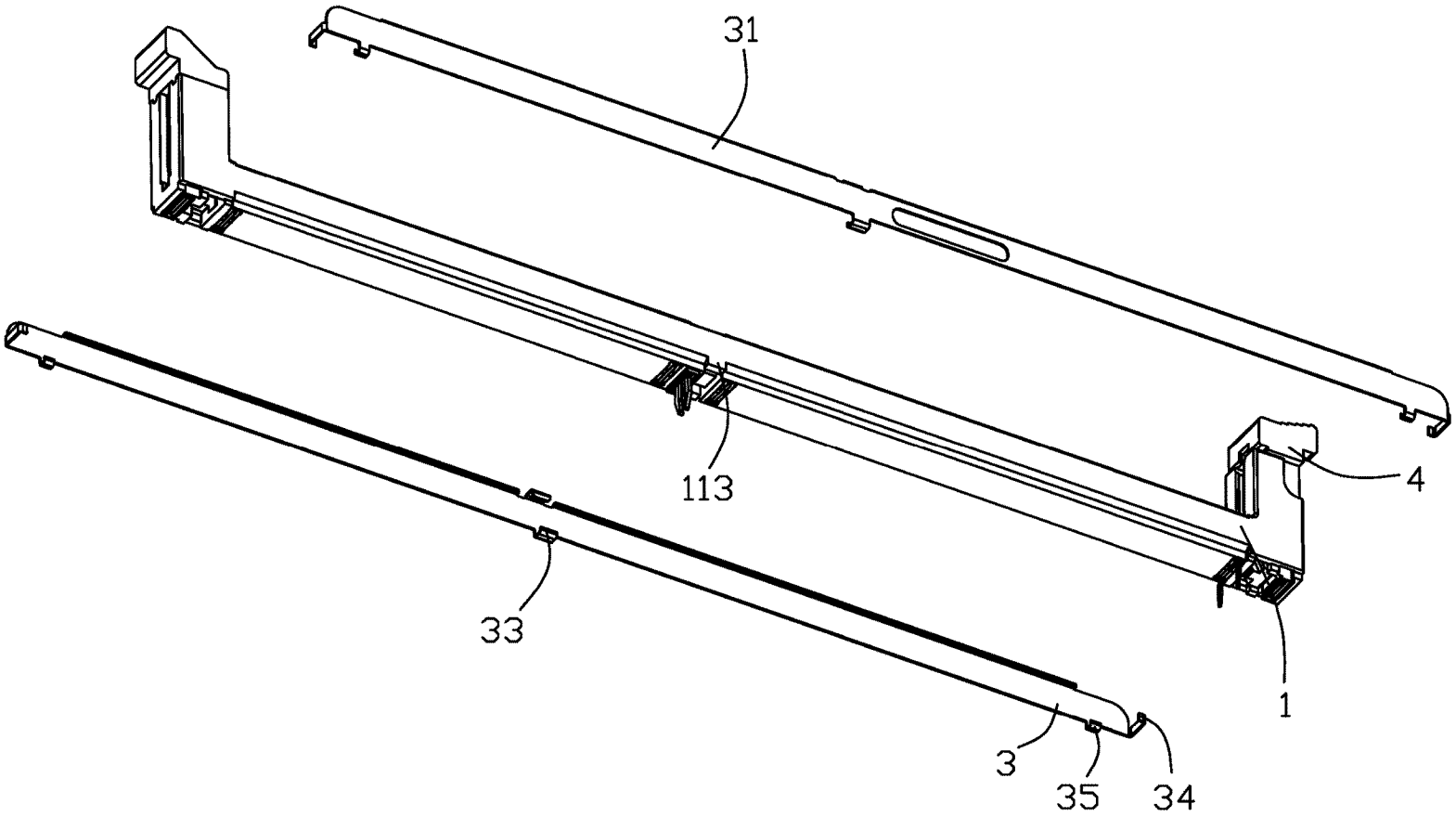
FIG. 5 is an another exploded perspective view of the card edge connector of FIG. 3.
Figure 6:
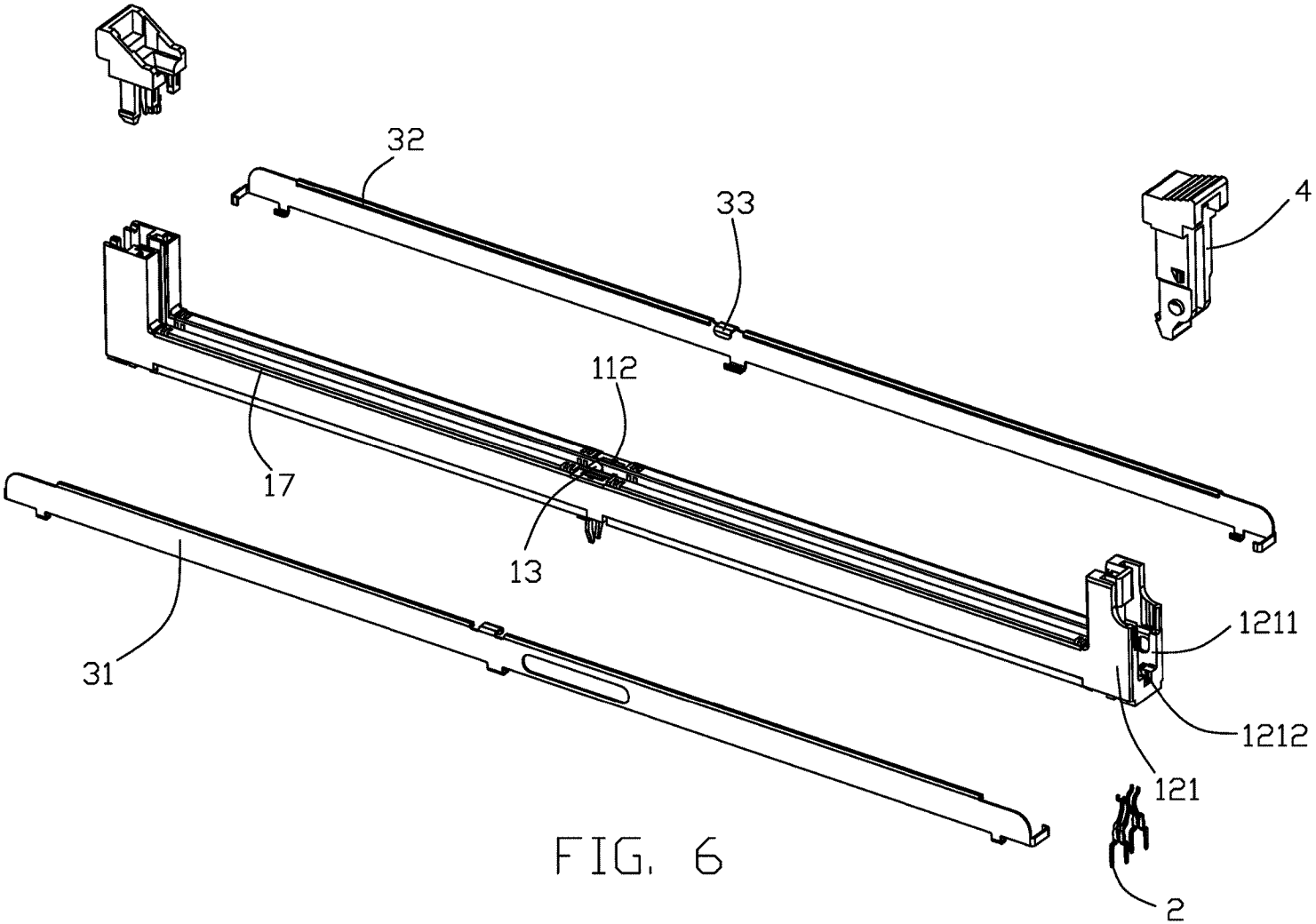
FIG. 6 is an another exploded view of the card edge connector of FIG. 1.
Figure 7:
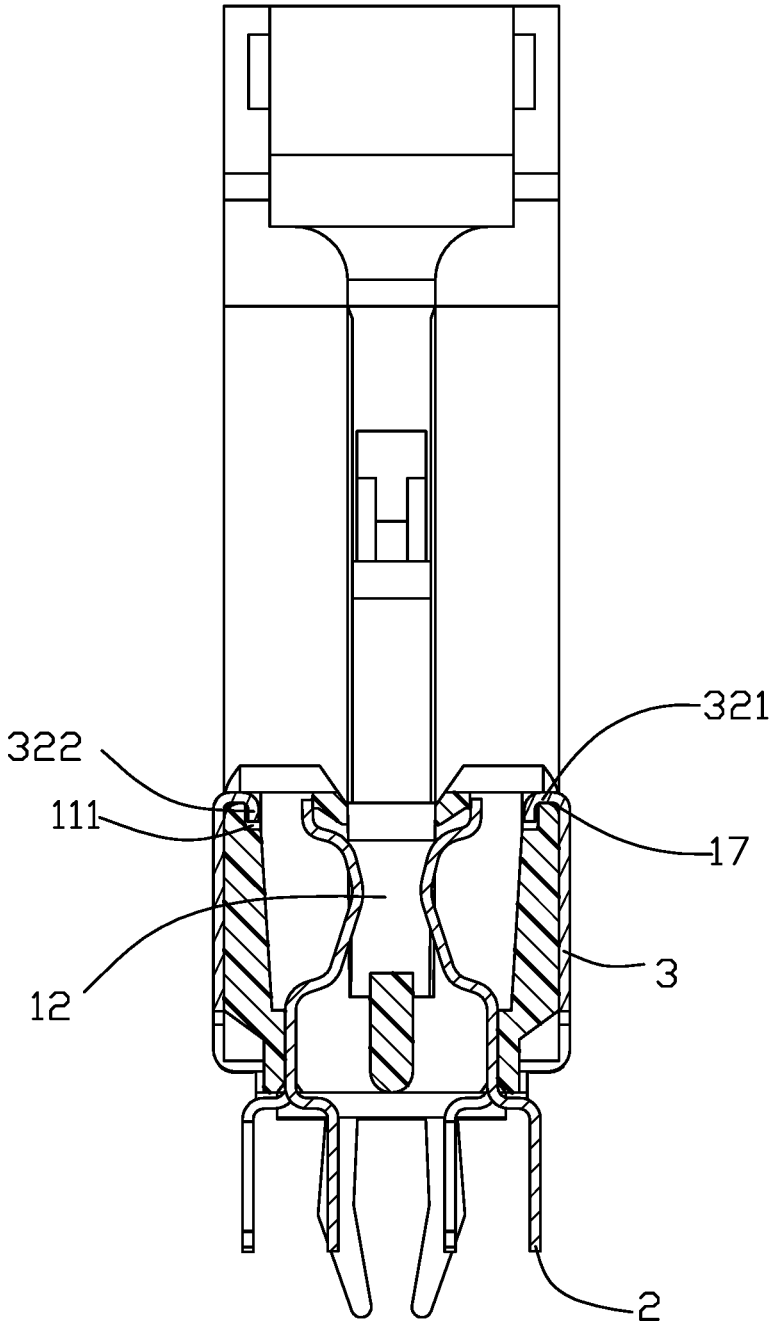
FIG. 7 is a vertical cross-sectional view of the card edge connector taken along line 7-7 in FIG. 1.
Figure 8:
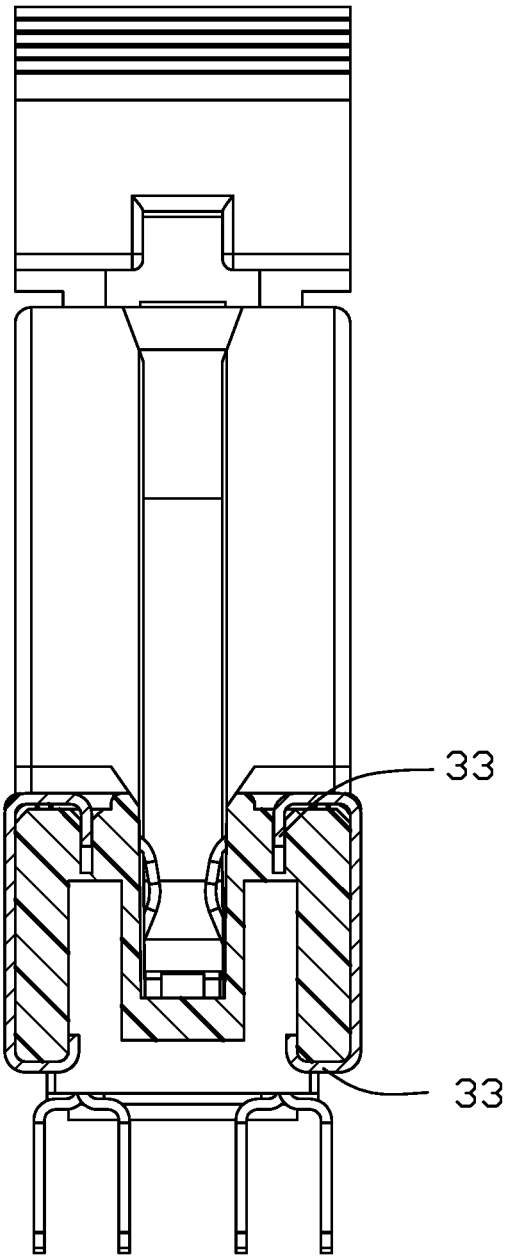
FIG. 8 is another vertical cross-sectional view of the card edge connector taken along a line around the first retaining groove in FIG. 1.
Figure 9:
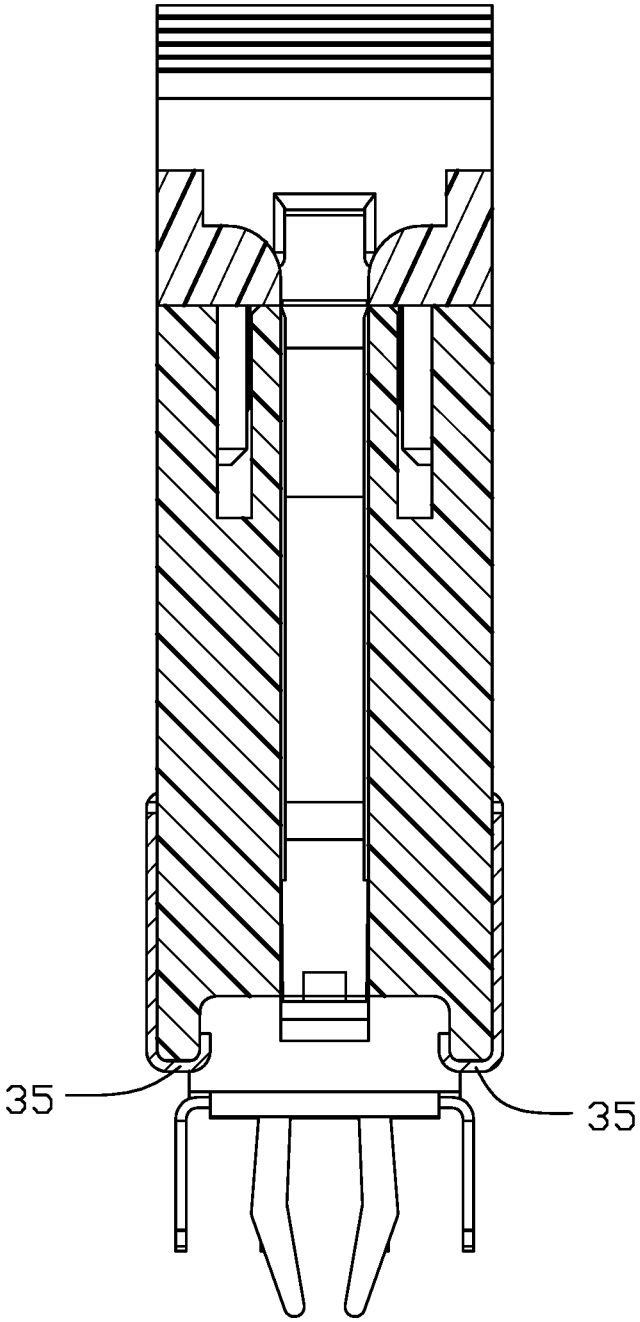
FIG. 9 is another vertical cross-sectional view of the card edge connector taken along a line around the tower portion in FIG. 1.
Figure 10:
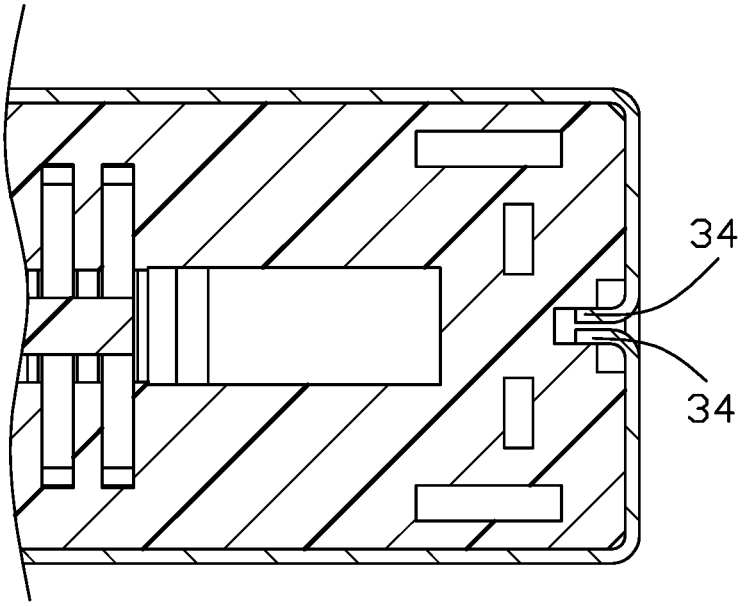
FIG. 10 is a partial horizontal cross-sectional view of the card edge connector taken along a line around the tower portion in FIG. 1.

Referring to FIG. 2 and FIG. 3, the insulative housing 1 defines two side walls 11 extending from a longitudinal direction perpendicular to the insertion direction, a central slot 12 disposed between said two side walls 11, a fool-proof key 13 disposed in the central slot 12 and two tower portions 121 disposed at two ends of the central slot 12, the latching mechanism 4 is assembled on one of the tower portion 121. The insulative housing 1 includes a top surface 14 and a mounting surface 15 opposite to the top surface 14, the central slot 12 penetrates the top surface 14, the top surface 14 of the insulative housing 1 is also too the top surface of the side wall 11. Each side wall 11 defines an embedded groove 111 recessed from the top surface 14 thereof in a slitting manner and extending along an outside of the side wall 11 in the longitudinal direction, the embedded groove 111 locates more closely to the outer side of the side wall 11 than the central slot 12. The insulative housing 1 defines a plurality of terminal grooves 16 disposed at two sides of the central slot 12 and arranged along a longitudinal direction, the conductive terminals 2 are enclosed in the terminal grooves 16 and protruding into central slot 12, the terminal grooves 16 are penetrating the top surface 14 of the side walls 11 and communicating with the two embedded grooves 111.

Referring to FIG. 3 to FIG. 7, the pair of metal members 3 are opposite and parallel to each other. Each metal member 3 defines a main portion 31 enclosing an outside of the side wall 11, a bending portion 32 bending from an upside thereof, two first retaining portions 33 retained in the side wall 11 and corresponding to the upside and downside of the fool-proof key 13, two second retaining portions 34 locked at the tower portion 121 and two third retaining portions 35 mounted at the bottom mounting surface 15 of the insulative housing 1, the bending portion 32 is assembled in the embedded groove 16. All of the first retaining portions 33, second retaining portions 34 and third retaining portions 35 are extending from one side of the metal member 3. The insulative housing 1 defines two first retaining grooves 112 for retaining the first retaining portions 33 near the fool-proof key 13, the mounting surface 15 defines two tabs 113 matching with the downside of first retaining portions 33, the tower portion 121 defines a mounting groove 1211 for the latching mechanism 4 to pivot and a second retaining groove 1212 disposed at the downside of the mounting groove 1211 to retain the second retaining portion 34. Due to the first retaining portions 33, second retaining portions 34 and the third retaining portions 35 are respectively lock to the insulative housing 1, it is stable that the metal member 3 is retained to the insulative housing 1. The bending portion 3 of the metal member 3 includes a horizontal part 321 bending inwardly form the main portion 31 and a vertical part 322 bending downwardly from the horizontal part 31, the horizontal part 321 is not higher than the top surface 14 of the side wall 11, the top surface 14 of the side wall 11 defines a recess 17 disposed at the upper side of the embedded groove 111 and communicating with the embedded groove 111. The terminal grooves 16 are penetrating the top surface 14 of the side walls 11 and communicating with the two embedded grooves 111 and the recess 17. The bending portion 32 of the metal member 3 is assembled to the embedded groove 111 along an up-to-down direction perpendicular to said longitudinal direction, specifically, the horizontal part 321 is saddling across the recess 17, the vertical part 322 is protectively retained in the embedded groove 111, the embedded groove 111 is penetrating the top surface 14 of the insulative housing 1 and paralleling to the central slot 12, however, the height of the embedded groove 111 is much less than central slot 12.

Above of all, because of the embedded grooves 111 are penetrating the up surface 14 of the insulative housing 1 and locating more closely to the outer side of the side wall 11 than the central slot 12, and the two metal members 3 respectively defines an U-shaped bending part 32 engaging with said embedded groove 111, not only the structural strength of the card edge connector 100 and the contacting strength of the top surface 14 of the insulating housing 1 can be raised, but also the metal element 3 can be stably assembled to the insulating housing 1, thereby preventing the metal element 3 from being warped, deformed or dropped off from the side wall 11 of the insulating housing 1, so as to enhancing the use performance of the card edge connector 100. In this embodiment, each metal element 3 has the second retaining portion 34 and the third retaining portion 35 grasping the housing 1 around the corresponding tower portion 121, and the first retaining portion 33 grasping the housing 1 around the fool-proof key 13. Simultaneously, each metal element 3 has the bending part 32 extending continuously along the longitudinal direction for continuously grasping the housing 1 around the top face so as to achieve reliable fixation between the metal element 3 and the housing 1 while still exposing an upper opening of each terminal groove 16 so as to facilitate heat dissipation. Notably, in this embodiment, the distal end region of each terminal 2 directly faces the bending part 32 in the transverse direction with therebetween a sufficient distance which is large enough to still separate the distal end region of the terminal 2 and the bending part 32 for no shorting therebetween when the terminal 2 is outwardly deflected by the electronic card inserted within the central slot 12. Understandably, this sufficient distance also assures full upward exposure of the terminal groove 16 to the exterior for heat dissipation.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A card edge connector comprising: an insulative housing defining two side walls extending in a longitudinal direction and a central slot disposed between said two side walls, a plurality of conductive terminals disposed in the insulative housing and protruding into the central slot; a pair of metal members enclosing the insulative housing; wherein each side wall defines an embedded groove recessed from a top surface thereof in a slitting manner, and extending along the side wall in said longitudinal direction, each metal member defines a main portion enclosing an outside of the side wall and a bending portion bending from an upside thereof, the bending portion is protectively retained in the embedded groove; wherein the insulative housing defines a fool-proof key disposed in the central slot and two tower portions disposed at two longitudinal ends of the central slot; wherein the bending portion with a U-shaped configuration, includes a horizontal part bending inwardly form the main portion and a vertical part bending downwardly and retained in the embedded groove, the top surface of the side wall defines a recess disposed at the outside of the embedded groove and communicating with the embedded groove.

2. The card edge connector as claimed in claim 1, wherein the embedded groove locates more closely to the outer side of the side wall than the central slot.

3. The card edge connector as claimed in claim 1, wherein the pair of metal members are opposite and parallel to each other.

4. The card edge connector as claimed in claim 1, wherein the metal member includes two first retaining portions retained in the side wall and corresponding to the upside and downside of the fool-proof key, two second retaining portions locked at the tower portion and two third retaining portions mounted at the bottom of the insulative housing.

5. The card edge connector as claimed in claim 4, wherein all of the first retaining portions, second retaining portions and third retaining portions are extending from one side of the metal member.

6. The card edge connector as claimed in claim 4, wherein the insulative housing includes a latching mechanism disposed on the insulative housing, a top surface and a mounting surface opposite to the top surface, the central slot penetrates the top surface, the insulative housing defines two first retaining grooves for retaining the first retaining portions near the fool-proof key, the mounting surface defines two tabs matching with the downside of the first retaining portions, the tower portion defines a mounting groove for the latching mechanism to pivot and a second retaining groove disposed at the downside of the mounting groove to retain the second retaining portion, the third retaining portion is retained to the mounting surface of said insulative housing.

7. The card edge connector as claimed in claim 1, wherein the insulative housing defines a plurality of terminal grooves disposed at two sides of the central slot and arranged along the longitudinal direction, the conductive terminals are enclosed in the terminal grooves, and some of the terminal grooves laterally communicate with the embedded grooves.

8. A card edge connector comprising:

an insulative housing defining two side walls extending along a longitudinal direction with therebetween a central slot in a transverse direction perpendicular to said longitudinal direction, said central slot communicating with an exterior in a vertical direction perpendicular to both said longitudinal direction and said transverse direction, each of said side walls defining opposite top surface and mounting surface in the vertical direction;

each of side walls defining a plurality of terminal grooves laterally communicating with the central slot in the transverse direction and upwardly communicating with the exterior;

a plurality of terminals disposed in the corresponding terminal grooves, respectively;

a pair of metal members attached upon the corresponding side walls, respectively, each of said metal members including a min portion enclosing an exterior surface of the corresponding side wall, and a bending portion grasping said top face of the housing; wherein an upper distal end region of the terminal and the bending portion is spaced from each other with a sufficient distance in the transverse direction for not only no shorting therebetween but also upward exposure of the corresponding terminal groove; wherein each of said metal members further includes an upper retaining portion extending toward the central slot farther than the bending portion in the transverse direction.

9. The card edge connector as claimed in claim 8, wherein said housing further includes a fool-proof key around a middle portion thereof in the longitudinal direction, and the upper retaining portion is located adjacent to the fool-proof key.

10. The card edge connector as claimed in claim 9, wherein each of said metal members further includes a lower retaining portion grasping the mounting surface of the housing around said fool-proof key.

11. The card edge connector as claimed in claim 8, wherein said bending portion extends continuously along the longitudinal direction almost through a whole length of the central slot.

12. The card edge connector as claimed in claim 8, wherein the housing includes a pair of tower portions at two ends of the central slot in said longitudinal direction, and each of said metal members includes a pair of retaining portions grasping said pair of tower portions, respectively.

13. The card edge connector as claimed in claim 12, wherein the retaining portions of said pair of metal members are engaged within a same recess of the same tower portions and face to each other in the transverse direction.

14. A card edge connector comprising:

an insulative housing defining two side walls extending along a longitudinal direction with therebetween a central slot in a transverse direction perpendicular to said longitudinal direction, said central slot communicating with an exterior in a vertical direction perpendicular to both said longitudinal direction and said transverse direction, each of said side walls defining opposite top surface and mounting surface in the vertical direction;

a fool-proof key formed in the central slot and linked with said two side walls in the transverse direction;

each of side walls defining a plurality of terminal grooves laterally communicating with the central slot in the transverse direction and upwardly communicating with the exterior;

a plurality of terminals disposed in the corresponding terminal grooves, respectively;

a pair of metal members attached upon the corresponding side walls, respectively, each of said metal members including a min portion enclosing an exterior surface of the corresponding side wall, and an upper retaining portion grasping said top face of the housing; wherein said retaining portion is located adjacent to said fool-proof key in the transverse direction while spaced from the neighboring terminal grooves in the longitudinal direction.

15. The card edge connector as claimed in claim 14, wherein each of said metal members further includes a lower retaining portion aligned with the upper retaining portion in the vertical direction and grasping a mounting surface of the housing around said fool-proof key.

16. The card edge connector as claimed in claim 15, wherein said housing includes a pair of tower portions at two opposite ends of the central slot in said longitudinal direction, and each of said metal members has a pair of end retaining portions grasping the corresponding tower portions, respectively.

17. The card edge connector as claimed in claim 16, wherein the end retaining portions of said pair of metal members are engaged with each other in the transverse direction.

* * * * *